US009587923B2

(12) United States Patent
Wurzel et al.

(10) Patent No.: US 9,587,923 B2
(45) Date of Patent: Mar. 7, 2017

(54) LOW COST GUIDING DEVICE FOR PROJECTILE AND METHOD OF OPERATION

(71) Applicant: BAE SYSTEMS ROKAR INTERNATIONAL LTD, Jerusalem (IL)

(72) Inventors: Gil Wurzel, Maas (IL); Assaf Malul, Jerusalem (IL)

(73) Assignee: BAE SYSTEMS ROKAR INTERNATIONAL LTD., Jerusalem (IL)

( * ) Notice: Subject to any disclaimer, the term of this patent is extended or adjusted under 35 U.S.C. 154(b) by 0 days.

(21) Appl. No.: 15/057,215

(22) Filed: Mar. 1, 2016

(65) Prior Publication Data

US 2016/0245631 A1 Aug. 25, 2016

Related U.S. Application Data

(63) Continuation of application No. 14/065,467, filed on Oct. 29, 2013, now Pat. No. 9,303,964.

(30) Foreign Application Priority Data

Dec. 31, 2012 (IL) ..... 224075

(51) Int. Cl.
*F42B 10/06* (2006.01)
*F42B 15/01* (2006.01)
(Continued)

(52) U.S. Cl.
CPC ..... *F42B 15/01* (2013.01); *F42B 10/04* (2013.01); *F42B 10/26* (2013.01); *F42B 10/64* (2013.01); *F42B 15/10* (2013.01)

(58) Field of Classification Search
CPC ..... F42B 10/02; F42B 10/26; F42B 10/64
See application file for complete search history.

(56) References Cited

U.S. PATENT DOCUMENTS 4,512,537 A 4/1985 Sebestyen et al.
4,964,593 A * 10/1990 Kranz ..... F42B 10/64 102/208

(Continued)

FOREIGN PATENT DOCUMENTS

FR 2674952 10/1992
WO WO2007030687 3/2007

OTHER PUBLICATIONS

Office Action for U.S. Appl. No. 15/057,215 dated Aug. 31, 2015.

(Continued)

*Primary Examiner* — Philip J Bonzell
(74) *Attorney, Agent, or Firm* — Pearl Cohen Zedek Latzer Baratz LLP

(57) ABSTRACT

A guiding assembly is adapted to be connected to a projectile and comprising a rear main unit adapted to be connected to the front end of the projectile, and a front main unit rotatably connected at its rear end to the front end of the rear main unit. The front main unit is adapted to rotate about a central longitudinal axis. A relative speed control unit is operable between the rear main unit and the front main unit and capable of providing spin braking force to slow the relative speed of rotation of the front main unit. An at least one guiding fin radially extends from the front main unit. The pitch angle of the fin is controllable by a return spring connected to the fin so that the pitch angle of the fin is growing as the aerodynamic pressure on the fin lowers and it is growing smaller as the aerodynamic pressure on the fin gets bigger.

7 Claims, 6 Drawing Sheets

(51) Int. Cl.

| | |
|---|---|
| ***F42B 10/64*** | (2006.01) |
| ***F42B 10/04*** | (2006.01) |
| ***F42B 10/26*** | (2006.01) |
| ***F42B 15/10*** | (2006.01) |

(56) References Cited

U.S. PATENT DOCUMENTS

| | | | | |
|---|---|---|---|---|
| 5,393,012 | A * | 2/1995 | Dunn | F42B 10/64 244/3.21 |
| 6,981,672 | B2 | 1/2006 | Clamcy et al. | |
| 7,718,937 | B1 * | 5/2010 | Dunn | F42B 10/64 244/3.11 |
| 8,916,810 | B2 * | 12/2014 | Geswender | F42B 10/64 244/3.23 |
| 2004/0164202 | A1 | 8/2004 | Klestadt et al. | |
| 2005/0056723 | A1 | 3/2005 | Clamcy et al. | |
| 2005/0116113 | A1 | 6/2005 | Lawless | |
| 2008/1315032 | | 12/2008 | Harnoy | |
| 2012/0048992 | A1 * | 3/2012 | Malul | F42B 10/64 244/3.24 |
| 2012/0248239 | A1 * | 10/2012 | Geswender | F42B 10/64 244/3.23 |
| 2012/1024823 | | 10/2012 | Geswender at al. | |

OTHER PUBLICATIONS

International Search Reprot for PCT Application No. PCT/IL2013/050871 dated Feb. 6, 2014.

Supplementary European Search Report for European Application No. EP13869242 dated Jul. 15, 2016.

* cited by examiner

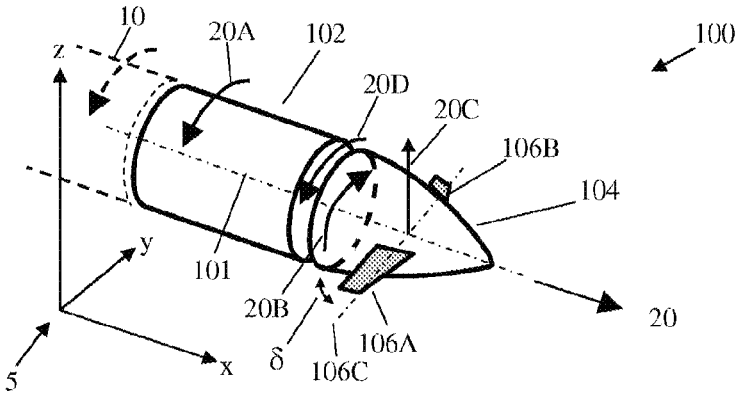
Fig. 1A
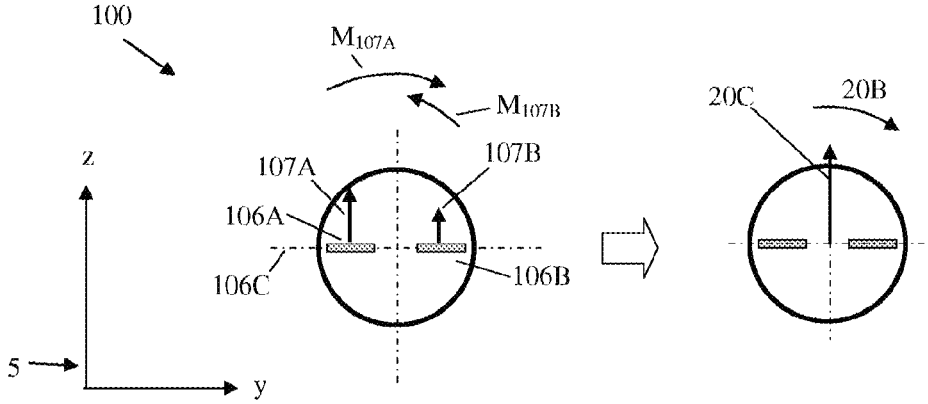
Fig. 1B
Fig. 1D
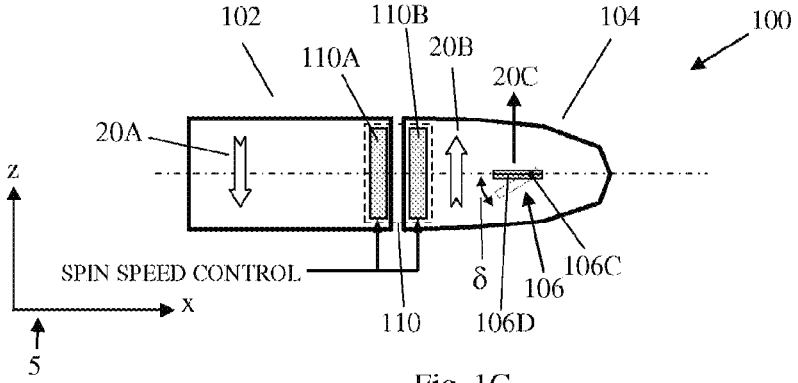
Fig. 1C $$F_S(x) = F_0 + K_S \times (X - L_0)$$

LOW COST GUIDING DEVICE FOR PROJECTILE AND METHOD OF OPERATION

CROSS REFERENCE TO RELATED APPLICATIONS

This application is a continuation of U.S. patent application Ser. No. 14/065,467, filed Oct. 29, 2013, which claims the benefit of Israeli Patent Application No. 224075, filed on Dec. 31, 2012, each of which is incorporated by reference in its entirety.

BACKGROUND OF THE INVENTION

Kits used for guiding of ballistic and direct aiming projectiles to their target are known in the art. Such kits are typically of relatively high precision and are very expensive or of relatively very low precision and of lower cost. Use of a projectile guiding kit is suitable where 'statistic firing' (that is, where a large number of ammunition units with low accuracy is fired towards one target in order to hit it) is expected to improve the ratio of circular error probability (CEP) to cost (number of fired ammunition units). In order to enable this improvement, at least one of the figures—cost of guiding kit and CEP—needs to improve, that is the cost of a guiding kit needs to get lower and/or the CEP of a projectile equipped with a guiding kit needs to improve, so that the product of both prove improved efficiency. While expensive guiding kits enable efficient guiding of a projectile, where less kinetic energy of the projectile is dissipated due to the guiding maneuvering, low-cost guiding kits known in the art typically dissipate a lot of the kinetic energy of the projectile and as a result shorten its range and lower its final speed, which in turn lower its accuracy. Typically, the cost of a guiding kit for a projectile is derived mainly from the number of control variables it consists.

One control variable is the amount of resistance to rotation provided between the main body of the projectile and the projectile guiding kit axially connected to it, typically in front of it. Most of the guiding kits consist of an alternator disposed between the main body of the projectile and its guiding kit. One or more fins that are installed on outer skin of the guiding kit frontal member may cause this member to rotate in a speed that is different from the rotation speed of the projectile and typically lower than that rotation speed. The difference in rotation speeds can be utilized to rotate a stator and rotor of an alternator (or a similar electricity producing device). The alternator may be loaded with a controllable electrical load. Changes in the amount of electrical load applied to the alternator will change the amount of rotational resistance produced by that alternator.

Additional control variables may be embodied by one or more fins (or canard wings), the angle of attack of which may be controlled to achieve various control targets such as stabilizing the rotation of the nose of the guiding kit with respect to an external reference frame, such as the horizon; providing lift and/or turn aerodynamic forces in order to guide the projectile to its target, etc. Each fin whose angle of attack needs to be controlled seriously raises the cost of the guiding kit, because a controllable actuator needs to be provided and to be attached between the guiding kit and the respective fin and to control its angle of attack at every moment of the flight.

U.S. Pat. No. 6,981,672 to Clancy et al. discloses a guiding kit with two pairs of aerodynamic surfaces (or canard fins) both having fixed angles of attack. The angles of attack of one pair of fins are selected to spin the nose of the guiding kit in a direction opposite to the direction of spin of the projectile. The angles of attack of the second pair of fins are selected so that, when the nose spins, their net effect on the projectile flight is null, and when the projectile nose does not spin with respect to an external reference frame this pair of fins induces a lateral force and moment on the projectile flight direction, in a direction that is substantially perpendicular to the plane of these fins. This guiding kit utilizes only one control variable—the amount of rotational resistance provided by a spin control coupling (e.g., an alternator). This guiding device needs to provide a large anti-spin power at the beginning of the trajectory due to the high aerodynamic forces induced on the aerodynamic surfaces at the very high flight speeds at the beginning of the trajectory. The high anti-rotational power causes a lot of energy dissipation (e.g., by heat dissipated at the electrical load). Further, the pre-set angles of attack, which practically need to be adjusted to some average flight speed, produce high aerodynamic drag during the first portion of the trajectory, which also causes energy dissipation additionally to that of the anti-spin energy dissipation. As a result, at the beginning of the trajectory a lot of energy is dissipated only because the fins have a fixed pre-set angle of attack that is adjusted for lower speeds. The dissipated energy is consumed from the kinetic energy of the projectile and/or from its rotational energy, which in both cases is a disadvantage because it causes the shortening of trajectory of the projectile and the lessening of the projectile's longitudinal stability. When the projectile approaches the highest point of the trajectory (typically between 1000 and 15,000 meters), the aerodynamic effect of the fins reaches its lowest aerodynamic efficiency point due to the drop in the projectile's speed and in air density. For example, a projectile for a 20 km range may reach an initial speed of 700 m/s when leaving the cannon, may reach a maximum flight height of 6000 m above the ground where the speed will be about 280 m/s and the speed when the projectile is at the end of the trajectory may be about 350 m/s. As may be seen, the flight speed of the projectile changes by more than 60% during its flight, and the air density may change by over 50% from low level density to the top of the trajectory. For a projectile adapted to reach a range of 40 km, the range of change in the flight parameters may be even higher. As a result, the efficiency of a guiding kit with aerodynamic surfaces set in fixed angles of attack drops even lower while the total energy loss grows higher as the range of the projectile extends. The requirement for a higher lift capability in order to provide better control capability, and the requirement to limit the fins' angle of attack in order to lower the drag at launch are conflicting and, therefore, force the designer to choose between them, causing the requirement for higher controllability to be compromised.

Guiding kits for projectile which are known in the art typically fail to prove the required improvement of the combination of the two features. Accordingly, there is a need for a low-cost, simple and accurate projectile guiding kit, or device, which is capable of adapting its performance to the changes in flight parameters along the flight trajectory.

SUMMARY OF THE INVENTION

A guiding assembly is adapted to be connected to a projectile comprising a rear main unit adapted to be connected at its rear side to the front end of the projectile. The rear main unit having a central longitudinal axis, a front main unit rotatably connected at its rear end to the front end of said rear main unit, a relative speed control unit and a single guiding fin radially extending from said front main unit. The front main unit is adapted to rotate about said central longitudinal axis. The relative speed control unit is operable between the rear main unit and the front main unit and capable of providing spin braking force to slow the relative speed of rotation of the front main unit. The braking force is controllable The guiding fin is shaped as a flat aerodynamic element having a fin chord extending from the front end of the fin to the rear end of the fin and residing in a plane parallel to the central longitudinal axis. The chord of the fin forms a pitch angle with said central longitudinal axis in a plane parallel to the central longitudinal axis. The pitch angle of the fin is controllable by a return spring connected to the fin so that the pitch angle of the fin is growing bigger as the aerodynamic pressure on the fin lowers and it is growing smaller as the aerodynamic pressure on the fin gets bigger.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 1A, 1B and 1C are schematic illustrations of a projectile guiding kit in isometric, front and side views, respectively, and FIG. 1D depicts an equivalency of fins vectors, according to embodiments of the present invention;

Figure 2A:
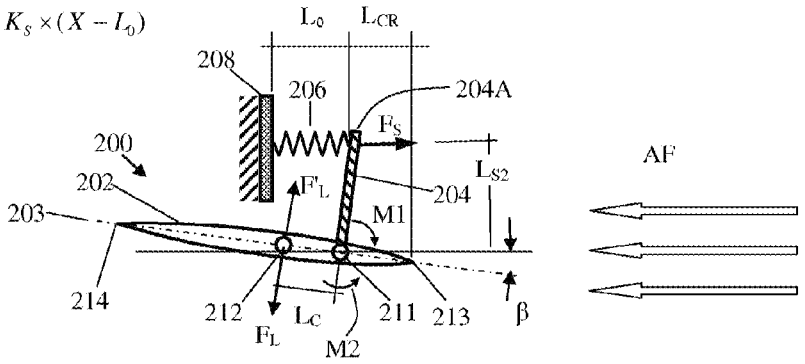
FIGS. 2A, 2B and 2C schematically depict a guiding fin assembly which is built, installed and operable according to embodiments of the present invention in various operating conditions.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The term projectile will be used herein below to describe all kinds of munitions that are made to be shot, fired, launched and the like from a mortar, cannon or rocket launcher and the like, and are made to spin around their longitudinal, forward pointing axis while in flight. Reference is made now to FIGS. 1A, 1B and 1C which are schematic illustrations of projectile guiding kit assembly 100 in isometric, front and side views, respectively, according to embodiments of the present invention. Guiding kit assembly 100 is presented with respect to external reference frame 5 with its 'x' axis substantially parallel to longitudinal axis 101, 'y' axis perpendicular to 'x' axis and parallel to the horizon and 'z' axis perpendicular to 'x' and 'y' axes and to the horizon. Guiding kit assembly 100 may comprise a rear main unit 102 and a front main unit 104 that are rotatably connected to each other so that the relative rotation is about the longitudinal axis 101 of guiding kit assembly 100. Guiding kit assembly 100 is adapted to be fixedly connected to projectile body 10, typically at its frontal end. Rear main unit 102 typically rotates about axis 101 together with projectile 10 in the same direction of rotation and the same speed of rotation. Front main unit 104 may be equipped with one or more fins 106 (in the example of FIGS. 1A, 1B and 1C, two guiding fins 106A and 106B are presented). Fins 106A, 106B may have a fixed angle of elevation of their chord line 106D with respect to the longitudinal central axis 101, or may be rotatable about a pitch axis 106C in the defined range of change of angle δ of chord 106D with respect to central longitudinal line 101. When fins 106 are rotatable, they may rotate about axis 106C. Pitch rotation axis 106C is substantially perpendicular to central longitudinal axis 101 and may cross through it. However, pitch rotation axis 106C may cross away from central longitudinal axis 101 as may be required by the specific design requirements.

Control variables associated with guiding kit assembly 100 are projectile spin rotation 20A, guiding kit assembly anti-spin rotation 20B, de-spin force 20D and projectile guiding vector 20C. Fins 106 may be adapted to provide an anti-spin force 20B, which needs to be at least slightly higher than the spin rotation force created through the friction with the projectile rotation 20A at any time of the projectile flight. Anti-spin force may be provided by proper selection of the areas of the fins 106A, 106B and their respective rotational angle of attack. A rotational angle of attack is defined as the angle of attack of each aerodynamic fin 106A, 106B, etc. as measured between the fin's chord line and a radial through the center line point of the guiding kit assembly measured for all fins in the same rotational direction. With this notation, if two fins (such as fins 106A, 106B), as shown in FIGS. 1A, 1B and 1C, are disposed around guiding kit assembly 100, have rotations opposed in direction and may be equal to or different from in magnitude and with equal or different aerodynamic areas, where the aerodynamic area of fin 106A can be larger than that of fin 106B, the relationship of the lift forces will be 107A>107B. Accordingly, moment of rotation $M_{107A}$ in the clockwise (CW) direction is larger than $M_{107B}$ in the counter-clockwise (CCW) direction. FIG. 1D depicts the algebraic sum of the lift forces 107A and 107B and of the moments $M_{107A}$ and $M_{107B}$, where:

$$20C=107A+107B$$

$$20B=M_{107A}-M_{107B}$$

Rear main unit 102 of guiding kit assembly 100 spins with the projectile. Front main unit 104 of guiding kit assembly 100 spins in an opposite direction and is capable of achieving anti-spin speeds higher than the spin speed. Relative speed control unit 110 may have rear speed control unit 110A and front speed control unit 110B, and each rotates with its respective main unit: rear speed control unit 110A rotates with projectile 10 and with rear main unit 102, and front speed control unit 110B rotates with front main unit 104. Relative speed control unit 110 may be embodied, for example, by an electrical alternator in which braking force, or braking torque, between one rotating part to the other rotating part may be achieved by electrically loading the alternator, which, as a result, induces braking force/torque between the rotating parts.

Control of the magnitude of the braking force may be achieved by control of the amount of load (e.g., the amount of current consumed from the alternator). Controlling the relative speed control unit 110 may be adapted to apply braking force between rear speed control unit 110A and front speed control unit. The magnitude of the braking force may be controlled to set the desired braking effect by applying the required torque. For example, relative speed control unit 110 may be adjusted to apply the required amount of braking force so as to slow anti-spin speed to the magnitude of spin speed. When the magnitudes of spin speed and anti-spin speeds are equal and in opposite directions, front unit 104 does not spin with respect to external reference frame 5. The braking force applied by relative speed control unit 110 may be changed (i.e., lowered or raised) for a short period of time, which as a result may cause front main unit 104 to change its angle of orientation about longitudinal axis 101. This angle is the direction at which radial force 20C, 134 is aimed, in the z-y plane from the z-axis, with respect to external reference frame 5. Accordingly, by the control of the braking force applied by relative speed control unit 110, the direction of radial force 20C, 134 may be set. This effect may be used to set the direction of operation of radial force 20C, 134. When radial force 20C, 134 is aimed parallel to the x-z plane, the aerodynamic force of vector 20C, 134 can contribute to produce lift force in order to extend the range of the projectile (or to shorten it when the vector is smaller than a certain size) with substantially no effect on the left-right corrections. When vector 20C, 134 is inclined with respect to the x-z plane, in the y direction at least some portion of the vector provides side-force acting laterally on the projectile and may be used to correct sideways deviations. Accordingly, if the deviation projectile 10 from its desired flight trajectory is to its right, relative speed control unit may change the braking force so as to turn front main unit 104 so that radial force 20C, 134 is aimed to the left of the trajectory, and thus to apply a correcting vector to projectile 10 as depicted by vector 20C'.

Figure 2B:
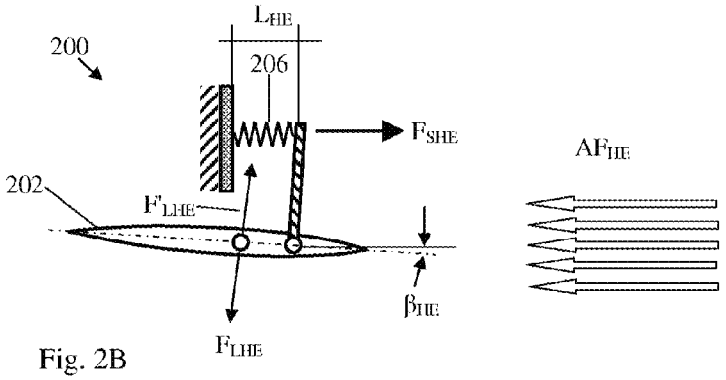
Figure 2C:
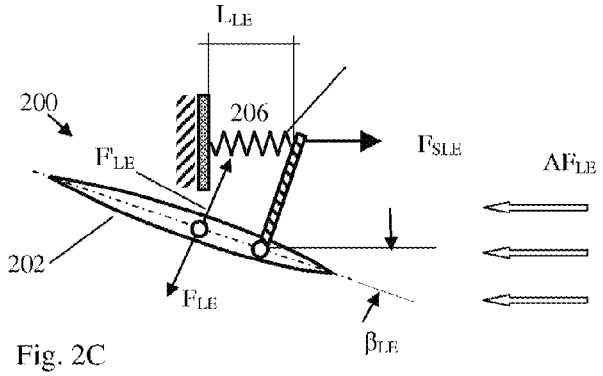

Reference is made now to FIGS. 2A, 2B and 2C, schematically depicting guiding fin assembly 200, which is built, installed and operable according to embodiments of the present invention, in various operating conditions. Guiding fin assembly 200 may comprise guiding fin 202, fin steering lever 204, fin movement-dependent strain element 206 and strain element anchoring point 208. Fin 202 is an aerodynamic two-sided flat element rotatably connectable to a front main unit of a guiding kit assembly, such as front main unit 104 of guiding kit assembly 100 (FIG. 1A) for guiding the flight of a projectile. Fin 202 is shown in a side view and its circumferential line may represent its shape close to the outer wall of the front main unit of the guiding kit assembly. Fin 202 may have a specific shape and size that may be adapted to the requirements stemming from the guiding requirements of the guiding kit assembly. Similarly, the material of which fin 202 may be built or prepared may be selected from a list of materials comprising aluminum alloy, steel alloy and titanium alloy. The constraints that may affect the selection of the shape, size and material of fin 202 may comprise: required maneuvering loads, dynamic requirements, allowed weight of fin 202 etc., as is known in the art. Fin 202 may be pivotally connected to a main front unit by pivotal connection having pivotal point 211, about which fin 202 may change its angle of rotation with respect to a reference frame connected to the front main unit. Fin 202, when exposed to fluid flow around it, such as the flow of air around it, for example as represented by arrows AF, may produce aerodynamic force $F_L$ that acts substantially perpendicular to the fin's chord line 203, and extends from the aerodynamic pressure center point 212 of fin 202. The fin's chord line extending from the front most end (the leading edge) 213 of fin 202 to the rear most point (the trailing edge) 214 of fin 202.

Fin steering lever 204 may be operatively connected at a first end to fin 202, so that movement of second end 204A of fin steering lever 204 may cause a change of the angle of chord 203 with respect to a reference frame connected to the front main unit. For example, the movement of second end 204A of steering lever 204, right and left in the plane of the drawing from its location in FIG. 2A, may cause change of the angle of chord 203 about pivot point 211. It will be apparent to one skilled in the art that the exact shape and way of operation of a steering lever according to embodiments of the present invention may be achieved by the installation of a straight lever, as depicted by steering lever 204, that is connected firmly to fin 202 at its first end 204B and may be operated to cause a change of angle β of chord 203 (and of fin 202 with it) when its second end 204A is moved around pivot point 211. However, other configurations of a steering element that is arranged to cause a change of the angle β when an operating point, such as second end 204A of lever 204, is moved may be used, as is known in the art. The location of pivot point 211 in the profile of fin 202 as shown in this side view may typically be on the fin's chord 203 and in a distance $L_{CR}$ from the front-most point 213 (the fin's leading edge). The distance $L_{CR}$ may be set to meet design requirements. For example, in guiding kits designed for projectiles that exceed the speed of sound, $L_{CR}$ will typically be very small, in order to avoid too dramatic effects due to the movement of the location of point 212 when the projectile crosses the speed of sound. The position along chord 203 of lift force operating point 212 is set mainly by the aerodynamic design of fin 202 and moves slightly back and force as the airspeed and the angle of attack change. The distance $L_C$ of point 212 from pivot point 211 is, therefore, dictated by the aerodynamic design of fin 202 and the location of pivot point along chord 203.

Second end point 204A of lever 202 may be connected to first end 206A of movement-dependent strain element 206 and its second end 206B may be anchored to strain element anchoring point 208, which is fixed with respect to pivot point 211. The operation of movement-dependent strain element 206 will be described hereinbelow with respect to a spring having a spring constant, or coefficient, k. However, other movement-dependent strain elements may be used, each one of them providing a strain force $F_S$ which depends on the amount of movement of second end 204A of lever 204 according to:

$$F_S(x)=F_0+K_S\times(X-L_0)$$

Where:

$K_S$ is the spring coefficient $F_0$ is the force to which the spring loaded at a certain starting point where X=0

$L_0$ is the length of the spring from point 206A to point 206B at a certain starting point, where X=0, and X is the displacement, or deflection, of first end 206A from second end 206B of the spring with respect to its initial starting (idle) position.

According to some embodiments of the present invention, other devices that are adapted to provide returning force proportional to a change in the rotational angle of fin 202 about pivot 211 may also be used Each one of variables $F_0$, $L_{S1}$, and X is a vector that may receive positive or negative values. It will be apparent to one skilled in the art that the variables $F_0$, $L_{S1}$, $K_S$, and X are design-dependent variables that may be set so as to meet design requirements. Similarly, the aerodynamic features of fin 202, for example its effective aerodynamic area and shape, the design of the fin's aerodynamic profile, the materials of which it is made and especially the dependence of the aerodynamic force $F_L$ on the air speed AF and on the angle β, as well as the adequacy of fin 202 to operate within the entire operational envelope of the projectile guiding kit assembly, are design considerations.

Fin 202 may be exposed during its flight, to flow of fluid on it AF, such as flow of air, in a very wide range of speeds, starting, artillery projectiles for 20-40 km range, from high speed (in the range of 600-1000 m/s and more) to very low speeds at the top of the ballistic trajectory (in the range of 280-300 m/s) and to low speeds at the end of the trajectory by the target (in the range of 360-380 m/s). Similarly, the air density (or density altitude) may change by over 80% from near sea level to the top of the trajectory. For example, for projectiles of 20-40 km range the air density may change between 1.2 kg/m$^3$ and 0.6-0.2 kg/m$^3$. The immediate effect of these phenomena is the great change in the aerodynamic performance of a fin, such as fin 202, along the flight trajectory. It will be apparent to one skilled in the art that, at higher airspeeds and higher air density, the aerodynamic efficiency of a fin, such as fin 202, is much higher than the efficiency at lower airspeeds and lower air density.

When fin 202 is subject to flow of air AF, aerodynamic force $F_L$ develops on fins' 202 surface. According to Newton's third law (action-reaction), when fin 202 is in equilibrium, the reacting force $F_L$ equals in magnitude and opposite in direction to $F_L$. $F_L$ exerts a moment M1 about pivot point 211 in the counter-clockwise direction. Moment M1 equals $-(F_L\times L_C)$. This moment is balanced by moment M2 exerted by force $F_S$ of spring 206 acting on lever 204. Accordingly, M2 equals $(F_S\times L_{S2})$. Fin 202 is shown in FIG. 2B in its position when relatively high aerodynamic energy (one or more of high airspeed and high air density) $AF_{HE}$ flows over it, as is typical to the first part of the trajectory, where the airspeed of a projectile is high and the altitude is still relatively low. Due to the high aerodynamic energy of the airflow, the aerodynamic force $FL_{HE}$ that develops on fin 202 is relatively high. At this situation, the angle of attack $\beta_{HE}$ of fin 202 satisfies the equilibrium of moments M1-M2 with movement-dependent strain element 206 extended to a length of $L_{HE}$. When the energy of the airflow goes lower (e.g., the energy of at least one the airspeed and the air density goes lower), as may be typical to close to the top of a ballistic trajectory, fin 202 reaches new equilibrium with angle of attack $\beta_{LE}$ and with movement-dependent strain element 206 extended to a length of $L_{LE}$. In the configuration shown in FIGS. 2B and 2C, the movement of lever 204 from the high energy position of FIG. 2B to that of lower energy of air flow in FIG. 2C causes the expansion of movement-dependent strain element 206 so that the energy stored in it when fin 202 is subject to air flow with higher energy is higher than that stored in it when fin 202 is subject to the effect of airflow with lower energy. The following holds:

$$\text{Energy of } AF_{HE}>\text{Energy of } AF_{LE}$$

$$L_{LE}^{1}>L_{HE}$$

$$\beta_{LE}>\beta_{HE}$$

Accordingly, when a projectile, such as projectile 10, equipped with a guiding assembly, such as guiding kit assembly 100, is in the beginning of the flight trajectory, experiencing very high airspeed and high density, the angle $\beta_{HE}$ of its fin, such as fin 202, is smaller than its angle $\beta_{LE}$ when the energy of the airflow goes lower. It will be appreciated by those skilled in the art that other initial settings of movement-dependent strain element 206, such as the value of initial displacement $L_0$, the magnitude and direction of initial load $F_0$ of element 206, etc. may be selected without deviating from embodiments of the invention.

Figure 3:
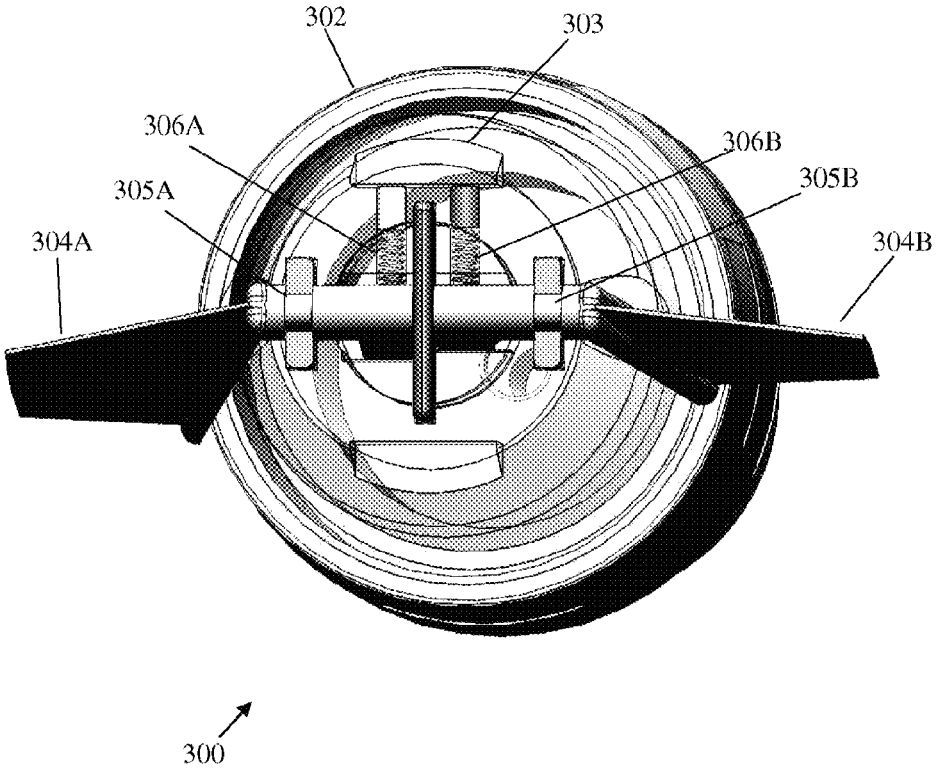
FIG. 3 depicts a schematic design of a front unit of a guiding fin assembly in a front isometric view, according to embodiments of the present invention.

Reference is made now to FIG. 3, depicting a schematic design of a front unit of a guiding fin assembly 300 in a front isometric view, according to embodiments of the present invention. Guiding fin front unit assembly 300 may comprise front unit element 302, two guiding fins 304A, 304B pivotally connected by pivots 305A, 305B, respectively, to guiding fin front unit assembly 300. Pivots 305A, 305B are operatively connected to springs 306A, 306B, respectively, via respective levers (not shown) so that, when the angle of attack or pitch angle of a fin gets bigger, the respective spring gets longer. Springs 306A, 306B are anchored at their non-moving ends to anchor element 303 that is fixedly connected to guiding fin front unit assembly 300.

It will be apparent to one skilled in the art that the aerodynamic features of fins 304A, 304B need not necessarily be the same. For example, one fin may be designed to have a bigger aerodynamic area, or a longer axial distance of its center of aerodynamic forces from the longitudinal axis of the guiding kit and/or from the pivot axis, compared with that of the other fin, etc. Similarly, the mechanical characteristics of the mechanics connecting each of the fins to its spring, and the characteristics of the springs, need not necessarily be the same.

Differences of corresponding characteristics may be designed to achieve different guiding goals or requirement. According to some embodiments of the present invention, the asymmetries may be as large as using only one fin instead of, for example, two fins, which may be considered as having one fin with aerodynamic area equal to zero.

Air density is a hyperbolic function of the altitude, in good approximation, with maximum values at lowest altitude and with half of the density of sea level at about altitude of 8000 m. The speed of a ballistic projectile along its trajectory is a combined function of ballistic friction-free calculations (where the only effect is that of the changing altitude and the change of kinetic energy to potential energy and vice versa) with the effect of the aerodynamic drag of the air on the projectile, which grows directly with the square of the airspeed value. The dependency of the desired angle of attack of a fin, such as fin 202, on the aerodynamic variables airflow speed and density along the flight trajectory of a projectile may have a complicated form. However, an inverse relation between the airspeed and air density to the angle of attack or pitch angle may be a good approximation. The mechanism according to embodiments of the present invention for continuously setting the angle of attack of a fin, such as fin 202, along the flight trajectory eliminates the need to actually calculate the momentary effect of the changes in the aerodynamic variables during flight. Instead, the fin, such as fin 202, actually 'samples' the changing effect of these variables along the trajectory by allowing the changes in the aerodynamic variables, as they are expressed in the produced aerodynamic lift on the fin, to change the angle of attack. For practical reasons the angle of pitch the fin will not extend beyond the range of 0 to 15 degrees. Less than zero will reverse the effect of the fin, and greater than 15 degrees may cause air stall on the fin's aerodynamic surface and as a result loss of aerodynamic efficiency.

Figure 4A:
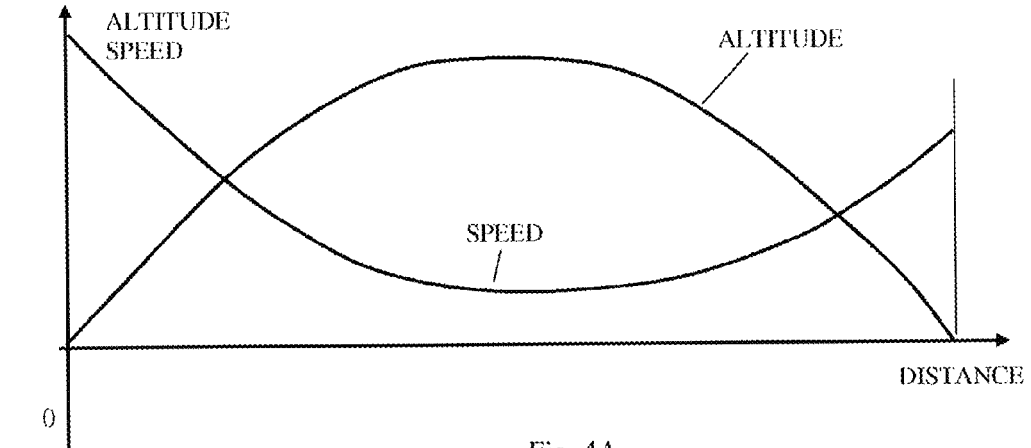
FIG. 4A is a qualitative graph depicting the changes in speed and in altitude with the distance travelled by a projectile.
Figure 4B:
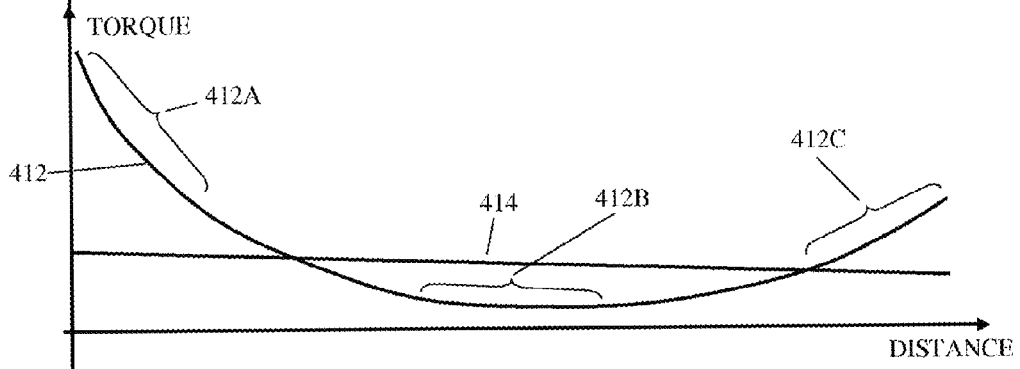
FIG. 4B is a qualitative graph depicting the changes in the torque provided by the braking means in a guiding kit using fins with fixed angels of attack versus the toque provided by a guiding kit according to embodiments of the present invention as a function of the distance travelled by a projectile.
Figure 4C:
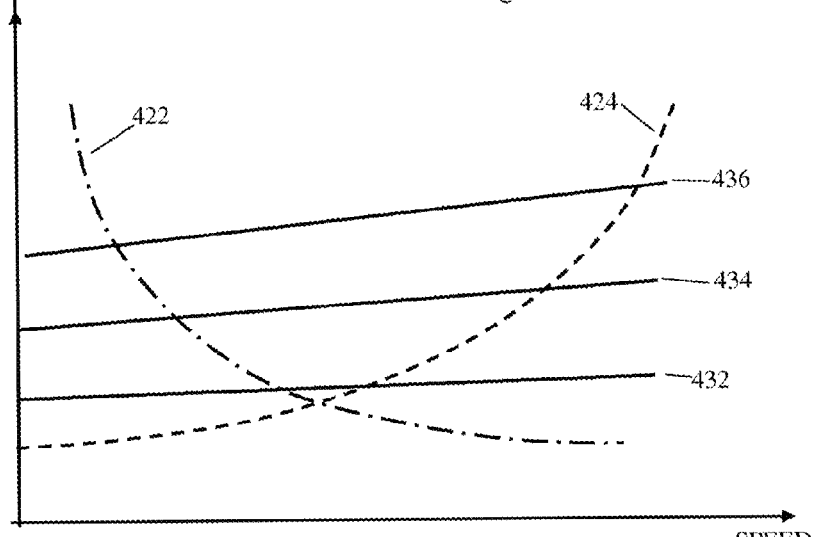
FIG. 4C is a qualitative graph depicting the changes in torque, lift and in aerodynamic drag provided by fins built and operating according to embodiments of the present invention as a function of the speed of a projectile versus the changes in torque, lift and drag provided by a guiding kit with fins having fixed angle of attack, and the change in the desired angle of attack as a function of the speed of a projectile.

Reference is made now to FIG. 4A, which is a qualitative graph depicting the changes in speed and in altitude with the distance travelled by a projectile, to FIG. 4B, which is a qualitative graph depicting the changes in the torque provided by the braking means in a guiding kit using fins with fixed angels of attack 412 versus the torque provided by a guiding kit according to embodiments of the present invention 414 as a function of the distance travelled by a projectile, and to FIG. 4C, which is a qualitative graph depicting the changes in torque 436, in lift 434 and in aerodynamic drag 432 provided by fins built and operating according to embodiments of the present invention as a function of the speed of a projectile versus the changes in torque, lift and drag 424 provided by a guiding kit with fins having fixed angle of attack, and the change in the desired angle of attack 422—all of the above as a function of the speed of a projectile. The graphs of speed and altitude of a ballistic projectile depicted in FIG. 4A are known in the art and are presented as presentation aids for the graphs presented in FIG. 4B and FIG. 4C.

As seen in FIG. 4B, a guiding kit having fins with fixed angle of attack provides torque that is very high in the first portion of the flight 412A, due to the subjecting of the fixed-angle this to a very high airspeed. The very high torque is required in order to maintain the front member of the guiding kit in a substantially fixed orientation with respect to the horizon in view of very high aerodynamic forces acting on the fins in high airspeed and high air density. As the speed and density drop, when the projectile gains altitude and loses speed, and especially when the projectile is in the vicinity of the top of the trajectory 412B, the required torque is at its minimum due to very low aerodynamic forces on the fins. Naturally, at this portion of the trajectory, fixed-angle fins may suffer under maneuvering capability. When the projectile begins to accelerate over the top of the trajectory, the aerodynamic force on the fins grows again, and the torque grows with it.

From graph 412, it is apparent that, in order to enable a fix-angle fin assembly to remain in substantially fixed angle with respect to the horizon, the braking assembly, e.g., an alternator, should be able to dissipate energy, typically in the form of heat, in a wide operational range. This is a design burden, since an alternator for such requirements needs to be heavier, with more ferrous material and more copper material. Furthermore, the high dissipated energy is consumed from the kinetic energy which leads to loss of range of the projectile. Contrary to the characteristics of graph 412, graph 414, depicting the torque produced by a braking unit, such as relative speed control unit 110 (FIG. 1C), operating in a guiding fin assembly according to embodiments of the present invention, such as guiding fin assembly 200, as seen in graph 414. Graph 414 is substantially linear and flat, which means that the torque provided by relative speed control unit 110 along the trajectory of the projectile equipped with a guiding fin assembly, according to embodiments of the present invention, such as guiding fin assembly 200, is substantially steady. What is even more important, the maximum value of energy dissipated at guiding fin assembly is very low, compared with that of the maximum energy dissipated in a fixed-angle fin assembly. This allows the use of a smaller and lighter relative speed control unit and indicates that much less energy needs to be dissipated in this configuration. Accordingly, a projectile equipped with guiding fin assembly according to embodiments of the present invention is expected to be able to fire to longer distance that that of a projectile equipped with guiding fin assembly having fixed angle of attack.

As seen in FIG. 4C the required angle of attack, that is the angle of attack that would give the required aerodynamic performance as a function of the airspeed, is a hyperbolic-like function with the highest values of the angle of attack at the lower speeds and lower air density (not shown here) achieved at the top of the trajectory and with lower angles of attack as the speed grows. Since the angle of attack of a fin according to embodiments of the present invention comply with the required angle of attack depicted by graph 422, as explained in detail above, the result is the changes of the changes in torque 436, in lift 434 and in aerodynamic drag 432 provided by fins built and operating according to embodiments of the present invention, as a function of the speed is substantially constant figure having a substantially flat graph.

Contrary to the behavior of guiding fin assembly according to embodiments of the present invention, such as guiding fin assembly 200, the changes in torque, lift and drag of a guiding fin assembly having fixed angel of attack as depicted, qualitatively, by graph 424, is an exponential function of the airspeed. The higher the airspeed the higher are the torque, lift and drag developing at the assembly.

Figure 5A:
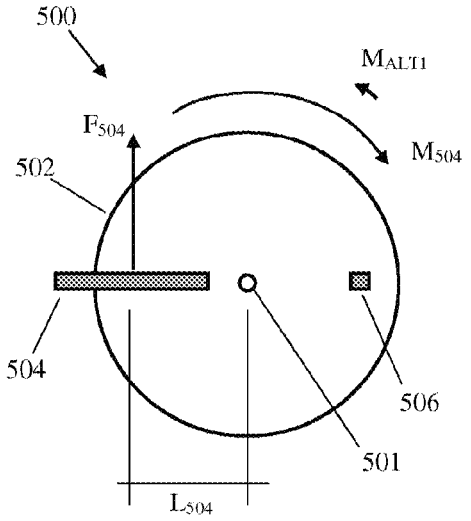
FIGS. 5A and 5B schematically present lift force and moments acting on a front main unit of a guiding fin assembly comprising a single guiding fin according to embodiments of the present invention.
Figure 5B:
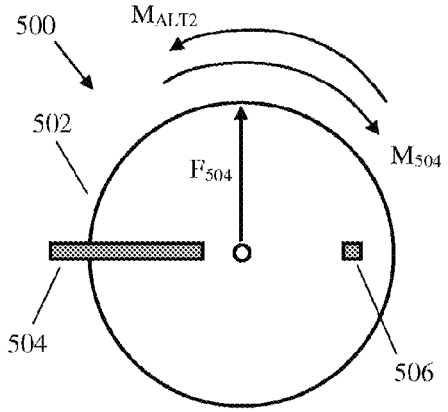

Reference is made now to FIGS. 5A and 5B, which schematically present lift force and moments acting on a front main unit 500 of a guiding fin assembly comprising a single guiding fin according to embodiments of the present invention. Front main unit 500, seen in a front view, comprises a single guiding fin 504 radially extending from body 502 of front main unit 500 and capable of changing its aerodynamic angle of attack as a balance between the aerodynamic forces of the fin and the return force of a restraining device, such as a spring, according to embodiments of the present invention. Body 502 is adapted to rotate about axis 501 (perpendicular to the plane of the page in FIGS. 5A and 5B) with respect to a rear main unit (not shown) of a guiding kit assembly according to embodiments of the present invention. Guiding fin 504 may be a spring controlled fin of the type described in FIGS. 2A, 2B and 2C. Accordingly, the way nature guiding fin 504 operates is controlled by the amount of the de-spin force provided by a speed control unit, such as an alternator (not shown). Front main unit 500 may further comprise counterweight 506 adapted to dynamically balance the dynamics of fin 504 about axis of rotation 501, but it has virtually no aerodynamic effect. The minimal de-spin moment that the alternator may provide, $M_{ALT\text{-}MIN}$, is deducted from, and is equal to the mechanical load caused by, the electricity consumed by the guiding kit systems, which is provided by the alternator. The maximum de-spin moment that the alternator may provide, $M_{ALT\text{-}MAX}$, is defined by the electrical load that may be connected to it. As discussed in detail above, this moment is set to provide de-spin moment that may reverse the direction of rotation of front main unit 500 or stop its spin with reference to an external reference frame.

Figure 5C:
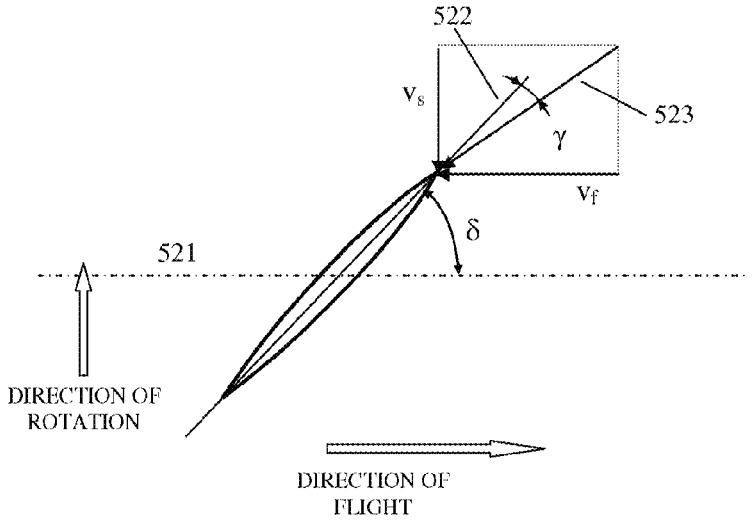
FIG. 5C is a schematic illustration of speed vectors and angles of a fin according to embodiments of the present invention.

Reference is made now to FIG. 5C, which is a schematic illustration of speed vectors and angles of a fin according to embodiments of the present invention. In a guiding kit with only one fin, the minimal aerodynamic drag depends only on the aerodynamic characteristics of the fin. In a guiding kit according to embodiments of the present invention, when the moment produced by the alternator is minimal (i.e., when no lift is produced and the only electricity consuming is that caused by the production of electricity for the kit's systems), the angle $\delta$ between the chord of the fin 522 and the longitudinal axis 521 of the guiding kit will be automatically set to be very close to its maximum by the force of the spring, absent a counter force caused by the breaking force of the load on the alternator. Yet, in these conditions, once the front main unit starts to spin, the effective (i.e., the aerodynamic) angle of attack $\gamma$, measured between the equivalent speed vector 523, combined from the forward airspeed $v_f$ and the rotational airspeed $v_s$ of the projectile, as experienced by the fin and the fins' chord 523, is very close to zero, due to the high rotational speed.

Figure 5D:
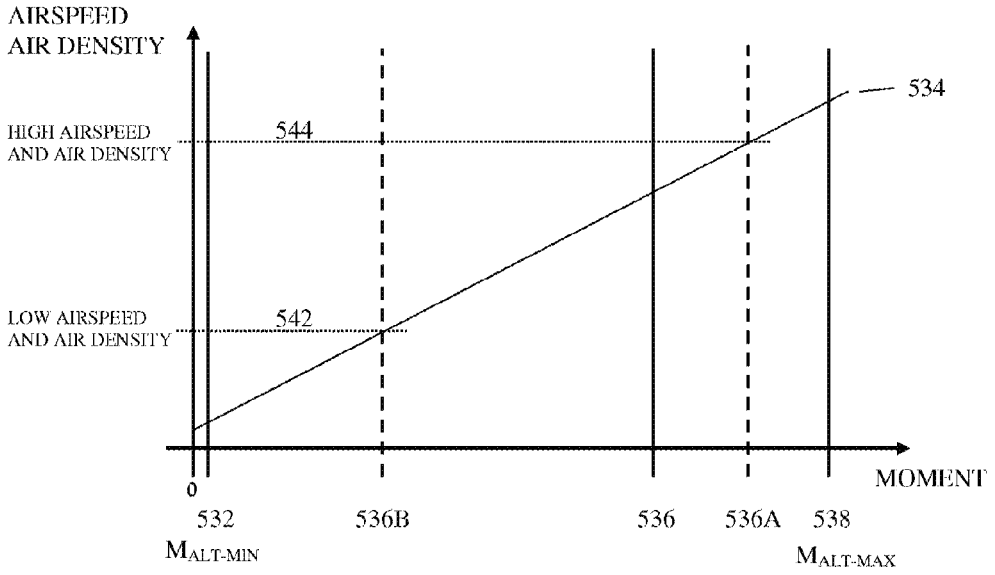
FIG. 5D is a graph illustrating magnitudes of moments as produced by a relative speed control unit according to embodiments of the present invention.

Reference is made now to FIG. 5D, which is a graph illustrating magnitudes of moments as produced by a relative speed control unit, such as unit 110 of FIG. 1C according to embodiments of the present invention. The minimal moment that needs to be provided by the relative speed control unit is $M_{ALT\text{-}MIN}$ denoted 532. As explained in detail above, this moment equals to the moment required by the alternator to provide electrical power to the projectile systems. The maximal moment that may be provided by the alternator, $M_{ALT\text{-}MIN}$, is denoted 538. Moment 536 represents the moment required to stop the spin of front unit 500 with respect to an external reference frame such as that of the globe. Moment 536 is the value of $M_{ALT2}$ when it equals to $M_{504}$. Moment 536 may change as the speed of rotation of the projectile changes. Typically it will be higher when the rotation speed of the projectile is higher and lower when the rotation speed of the projectile is lower. Moment 536 may also change as the linear speed (the airspeed) of the projectile and the air density change. Typically, when the airspeed and the density are high (i.e., the aerodynamic efficiency is high), the values of moment 536 will be higher than those when the airspeed and air density are lower. Graph line 534 schematically represents the value of moment 536 as a function of the aerodynamic efficiency of a guiding device. Graph line 534 should not necessarily be straight. For low airspeed and air density 542, as may exist close to the highest point of a ballistic trajectory of a projectile, a lower moment 536 is required. For high airspeed and air density 544, as may exist close the firing point or to the target, higher moment 536 is required.

In a guiding kit with one fin having a fixed angle of attack, typically set to value in the middle of the range of required angles of attack, the minimal drag will be higher that that of a fin with adjustable angle of attack according to embodiments of the present invention for virtually the whole range of angles of attack. Additionally, in a guiding kit comprising a fixed-angle fin, the acceleration of the rotational speed will be slower since the angle of attack in the beginning of the rotation is not at maximum as is the case with a fin with adjustable angle of attack according to embodiments of the present invention. In guiding kits comprising a single guiding fin, whether with an adjustable angle of attack or with a fixed angle of attack, when no correcting force vector is required (i.e., the projectile performs a desired trajectory) the loading of the alternator may be set to minimal (i.e., the alternator provides electricity only to the systems of the guiding kit) and as a result the front main unit of the kit will turn rapidly about its longitudinal axis providing guiding vector equal to zero and minimal aerodynamic drag.

In a guiding kit with two fins, typically the fins will have angle of attacks that produce contradicting moments with different magnitudes. As a result, even when minimal moment is produced by the alternator, and the front main unit of the guiding kit turns rapidly in a direction opposite to that of the projectile, one of the fins experiences high angle of attack and, therefore, produces high drag and as a result lowers the aerodynamic efficiency of the projectile. It will be apparent to one skilled in the art that when more than one fin is comprised in a guiding kit the minimal moment produced by the alternator is higher than that of a kit with only one fin. Accordingly, the value of moment 534 is higher than that of 532. Such an arrangement is typically used to extend the lift force produced by the fins compared with the lift produced by a single fin and to reduce the maximum power required to be consumable from the alternator for breaking purposes, as described above. However, the improvement in lowering the required loading on the alternator is paid by the extended aerodynamic drag.

The selection of the specific type of guiding kit may be dictated by the specific needs of the specific use, whereby, in each selected type and configuration of the guiding kit, the product of money saving and enhanced target hit precision shall be kept as high as possible. For munitions that do not reach high altitudes and/or do not experience high changes in the airspeed along the trajectory, such as mortar shells, a guiding kit with a single fin having a fixed angle of attack may be selected. The angle of attack may be selected to provide best compromise between keeping the aerodynamic drag as low as possible, ensuring that the aerodynamic forces along the trajectory will be high enough to provide the required trajectory correction and ensuring that at all times along the trajectory there will be enough electricity to supply the guiding kit systems. Additional benefits of this embodiment are low aerodynamic drag, compared with guiding kits with two or more fins, limited shaking of the guided projectile about its longitudinal axis when no corrections to the trajectory are required and the front main unit of the guiding kit rapidly spins and quick build up of electrical power by the alternator to the guiding kit systems due to the rapid spin of the front main unit of the guiding kit at the beginning of the trajectory.

For munitions used for long ranges (for example 20 km and higher), where the airspeed and the air density change a lot along the trajectory of the projectile, a guiding kit with a single fin having adjustable angle of attack controlled by a spring may be selected to provide solution that is cheap compared to guiding kits using motor control of the angle of attack, is capable to adjust the fin's angle of attack to the changes in the aerodynamic parameters, which produces low aerodynamic drag, maintains low shaking of the projectile when no corrections to the trajectory are performed and which is capable of providing high amount of electricity shortly after launch.

For munitions that start their trajectory with relatively low airspeed, such as rockets, a guiding kit according to embodiments of the present invention with even only on fin may be capable of producing the required amount of electricity very close after the launch of the rocket due to its ability to rapidly accelerate the rotational speed of the front main unit.

For munitions with high mass inertia, where relatively high correction forces may be required, a guiding kit with two finds, according to embodiments of the present invention may be selected, because this arrangement produces higher lift forces.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A guiding assembly adapted to be connected to a projectile, comprising:

a rear main unit adapted to be connected at its rear side to a front end of said projectile, said rear main unit having a central longitudinal axis;

a front main unit rotatably connected at its rear end to a front end of said rear main unit and adapted to rotate about said central longitudinal axis;

a relative speed control unit operable between said rear main unit and said front main unit and capable of providing spin braking force to slow the relative speed of rotation of said front main unit, wherein said braking force is controllable;

two guiding fins radially extending from said front main unit, wherein each of said guiding fins is shaped as a flat aerodynamic element having a fin chord extending from the front end of the fin to the rear end of the fin and residing in a plane parallel to said central longitudinal axis, said chord of said fin forms a pitch angle with said central longitudinal axis in said plane parallel to said central longitudinal axis; and a return spring, operably connected to said guiding fins, wherein said spring is configured to allow movement correspondingly to aerodynamic pressure on the fins, and wherein said pitch angle is controllable by said spring.

2. The guiding assembly of claim 1, wherein said pitch angle of said single fin is set at a fixed angle between zero and fifteen degrees.

3. The guiding assembly of claim 1, wherein said relative speed control unit is an electrical alternator, and wherein the braking force of it is controllable by controlling the amount of electrical power consumed from the alternator.

4. The guiding assembly of claim 1, wherein the size and pitch angle of said guiding fin are big enough for causing said front main unit to spin in a rotational speed that is faster than the rotational speed of said projectile and is opposite to it in direction, when said projectile is in its trajectory.

5. The guiding assembly of claim 1, wherein the pitch angle of said fin is controllable.

6. The guiding assembly of claim 5, wherein the pitch angle of said fins is growing larger as the aerodynamic pressure on the fin lowers and it is growing smaller as the aerodynamic pressure on the fin gets bigger.

7. The guiding assembly of claim 1, wherein the aerodynamic area of one of the two guiding fins is substantially larger than the other guiding fin.

* * * * *